United States Patent [19]

Fantuzzo et al.

[11] Patent Number: 4,935,788

[45] Date of Patent: Jun. 19, 1990

[54] MULTICOLOR PRINTING SYSTEM

[75] Inventors: Joseph Fantuzzo, Webster; Lawrence J. Fraser, Rochester; Edwin R. Monkelbaan, Fairport; Thomas Robson, Penfield, all of N.Y.

[73] Assignee: Xerox Corporation, Stamford, Conn.

[21] Appl. No.: 207,421

[22] Filed: Jun. 16, 1988

[51] Int. Cl.[5] ..... G03G 15/01

[52] U.S. Cl. ..... 355/326; 355/256

[58] Field of Search ..... 355/326, 327, 256, 271

[56] References Cited

U.S. PATENT DOCUMENTS

| | | | |
|---|---|---|---|
| 3,392,667 | 7/1968 | Cassel et al. | 101/170 |
| 3,399,611 | 9/1968 | Lusher | 95/1.7 |
| 3,955,530 | 5/1976 | Knechtel | 118/60 |
| 3,957,367 | 5/1976 | Goel | 355/4 |
| 4,162,843 | 7/1979 | Inoue et al. | 355/327 |
| 4,183,658 | 1/1980 | Winthaegen | 355/277 X |
| 4,348,098 | 9/1982 | Koizumi | 355/3 TR |
| 4,515,460 | 5/1985 | Knechtel | 355/3 TR |
| 4,521,502 | 6/1985 | Sakai et al. | 355/327 X |
| 4,588,279 | 5/1986 | Fukuchi et al. | 355/3 TR |
| 4,690,539 | 9/1987 | Radulski et al. | 355/326 |

*Primary Examiner*—Fred L. Braun

*Attorney, Agent, or Firm*—H. Fleischer; J. E. Beck; R. Zibelli

[57] ABSTRACT

A multicolor printing system of the type in which a plurality of latent images are recorded therein. Each one of the plurality of latent images are developed with a different color liquid developer material to form a plurality of different color liquid images. The different color liquid images are transferred, in superimposed registration with one another, to an intermediate member to form a multicolor liquid image thereon. Thereafter, the multicolor liquid image is, in turn, transferred to a sheet and fused thereto.

2 Claims, 2 Drawing Sheets

MULTICOLOR PRINTING SYSTEM

Figure 1:
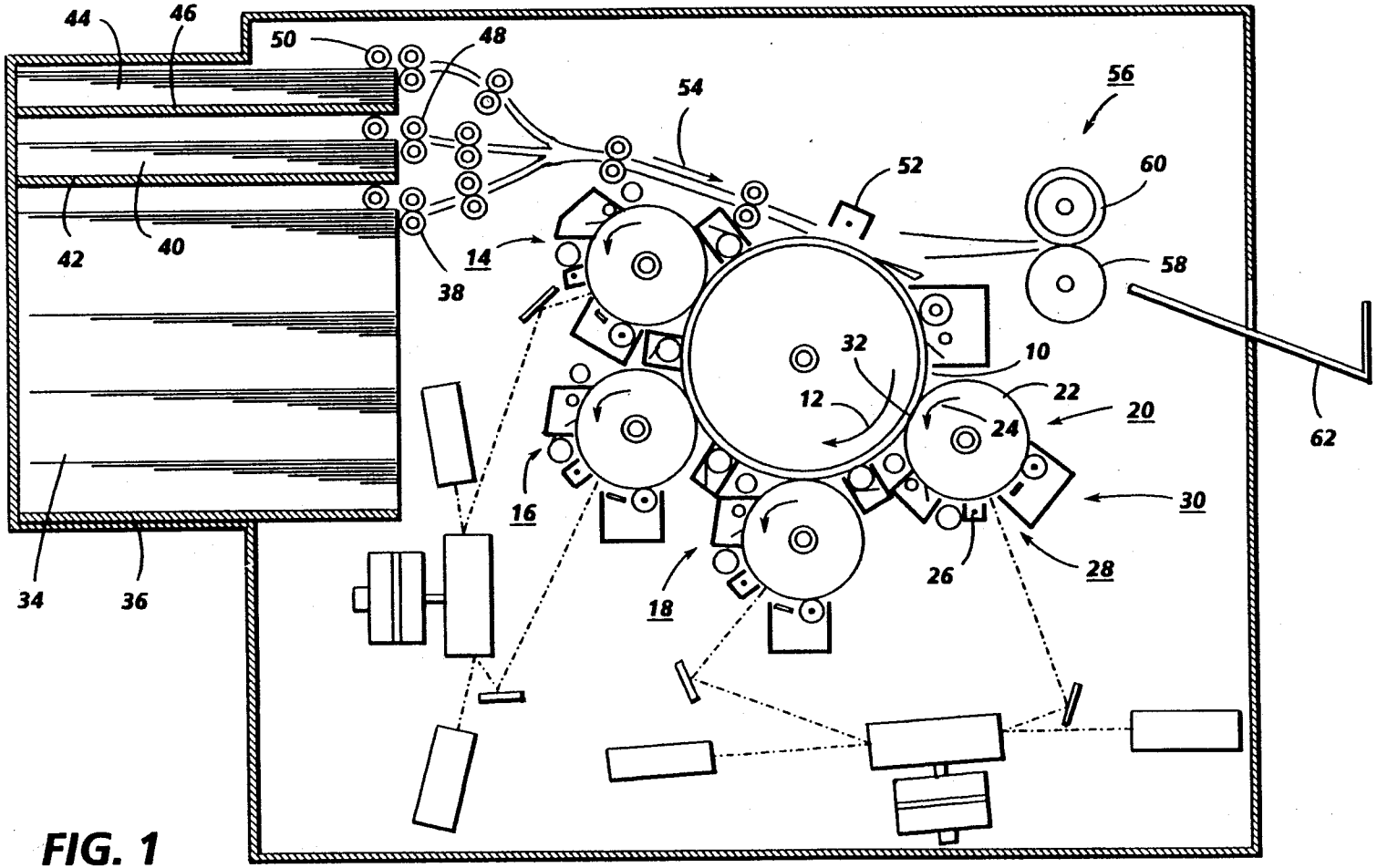

This invention relates generally to a multicolor printing system, and more particularly concerns forming a multicolor liquid image on an intermediate member and transferring the multicolor liquid image to a sheet of support material.

Hereinbefore, multicolor copying was achieved by using a multicolor electrophotographic printing machine. In the process of electrophotographic printing, a photoconductive surface is charged to a substantially uniform potential. The photoconductive surface is image wise exposed to record an electrostatic latent image corresponding to the informational areas of an original document being reproduced. This records an electrostatic latent image on the photoconductive surface corresponding to the informational areas contained within the original document. Thereafter, a developer material is transported into contact with the electrostatic latent image. Toner particles are attracted from the carrier granules of the developer material onto the latent image. The resultant toner powder image is then transferred from the photoconductive surface to a copy sheet and permanently affixed thereto. The foregoing generally describes a typical black and white electrophotographic copying machine. With the advent of multicolor electrophotographic printing, the process is repeated for three or four cycles. Thus, the charged photoconductive surface is exposed to a filtered light image. The resultant electrostatic latent image is then developed with toner particles corresponding in color to the subtractive primary of the filtered light image. For example, when a red filter is employed, the electrostatic latent image is developed with cyan toner particles. The cyan toner powder image is then transferred to the copy sheet. The foregoing process is repeated for a green filtered light image which is developed with magenta toner particles and a blue filtered light image which is developed with yellow toner particles. Each differently colored toner powdered image is sequentially transferred to the copy sheet in superimposed registration with the powder image previously transferred thereto. In this way, three toner powder images are transferred sequentially to the copy sheet. After the toner powder images have been transferred to the copy sheet, they are permanently fused thereto. Thus, color electrophotographic machines previously employed required three passes to produce a multicolor copy. This, of course, reduced the speed of the printing machine. In addition, successive toner powder images must be transferred in alignment with one another. This requires that successive toner powder images must be precisely aligned with the copy sheet and one another during each cycle. A typical electrophotographic printing machine employing the foregoing process is manufactured by the Xerox Corporation under the model name 1005.

In other types of multicolor printing systems, the toner powder images are transferred to an intermediate roller. In a system of this type, successive toner powder images are transferred, in superimposed registration with one another, from the photoconductive drum to an intermediate roller. These systems may also use three or four photoconductive drums in lieu of a single photoconductive drum.

Various approaches have been devised to produce multicolor color copies. The following disclosures appear to be relevant:

U.S. Pat. No. 3,392,667
Patentee: Cassel et al.
Issued: July 16, 1968
U.S. Pat. No. 3,399,611
Patentee: Lusher
Issued: September 3, 1968
U.S. Pat. No. 3,955,530
Patentee: Knechtel
Issued: May 11, 1976
U.S. Pat. No. 3,957,367
Patentee: Goel
Issued: May 18, 1976
U.S. Pat. No. 4,348,098
Patentee: Koizumi
Issued: September 7, 1982
U.S. Pat. No. 4,515,460
Patentee: Knechtel
Issued: May 7, 1985
U.S. Pat. No. 4,588,279
Patentee: Fukuchi et al.
Issued: May 13, 1986

The disclosures of the above-identified patents may be briefly summarized as follows:

U.S. Pat. No. 3,392,667 discloses a plurality of print cylinders having gravure engravings on their peripheries. Powder feed hoppers having rotating brushes apply powder to the print cylinders. The powder images from the print cylinders are transferred to an offset roller in superimposed registration with one another. The resultant powder image is then transferred from the offset roller to paper or sheeting.

U.S. Pat. No. 3,399,611 describes four image transfer stations diposed about the periphery of a rotatable cylindrical metal drum. Each image transfer station is basically the same and includes a photoconductive drum charged by a charging wire and then rotated into alignment with an image exposure station to record a latent image thereon. Powder particles are then cascaded across the latent image to develop it. The powder image is then transferred to the surface of the metal drum. The powder particles are of different colors. The completed powder image is transferred from the metal drum to an article to be decorated.

U.S. Pat. No. 3,955,530 discloses a color image forming electrophotographic printing machine. Different color developers are used to develop the latent images recorded on the photoconductive drum. Each developed image is sequentially transferred to an intermediate transfer drum. A cleaning blade is used to clean the photoconductive drum between developing different color developers. The complete image is transferred from the intermediate drum to a copy sheet.

U.S. Pat. No. 3,957,367 describes a color electrophotographic printing machine in which successive different color toner powder images are transferred from a photoconductive drum to an intermediate roller, in superimposed registration with one another, to an intermediary roller. The multi-layered toner powder image is fused on the intermediary roller and transferred to the copy sheet.

U.S. Pat. No. 4,348,098 discloses an electrophotographic copying apparatus which uses a transfix system. In a transfix system, the developed image is transferred from the photoconductive member to an intermediate roller. The intermediate roller defines a nip with a fixing roller through which the copy sheet passes. The developed image is then transferred from the intermediate roller to a copy sheet. The developing unit of the copying apparatus may either be a dry or wet type.

U.S. Pat. No. 4,515,460 describes a color electrophotographic copying machine in which four developer units develop four latent images recorded on a photoconductive drum with different color toner particles. The different color toner powder images are transferred to an endless belt in superimposed registration with one another. The resultant toner powder image is then transferred from the belt to a copy sheet.

U.S. Pat. No. 4,588,279 discloses an intermediate transfer member that has a dry toner image transferred thereto from the surface of a toner image forming member. The toner image is then transferred from the transfer member to a recording paper.

In accordance with one aspect of the features of the present invention, there is provided a multicolor printing system of the type having a plurality of latent images recorded therein. The printing system includes means for developing each of the plurality of latent images with a different color liquid developer material to form a plurality of different color liquid images. An intermediate member is provided. First means transfer each one of the plurality of different color liquid images to the intermediate member in superimposed registration with one another to form a multicolor liquid image thereon.

Pursuant to another aspect of the present invention, there is provided a method of multicolor printing of the type in which a plurality of latent images are recorded in the printing system. The method of multicolor printing includes the step of developing each of the plurality of latent images with a different color liquid developer material to form a plurality of different color liquid images. Each one of the plurality of different color liquid images are transferred to an intermediate member in superimposed registration with one another to form a multicolor liquid image thereon.

Figure 2:
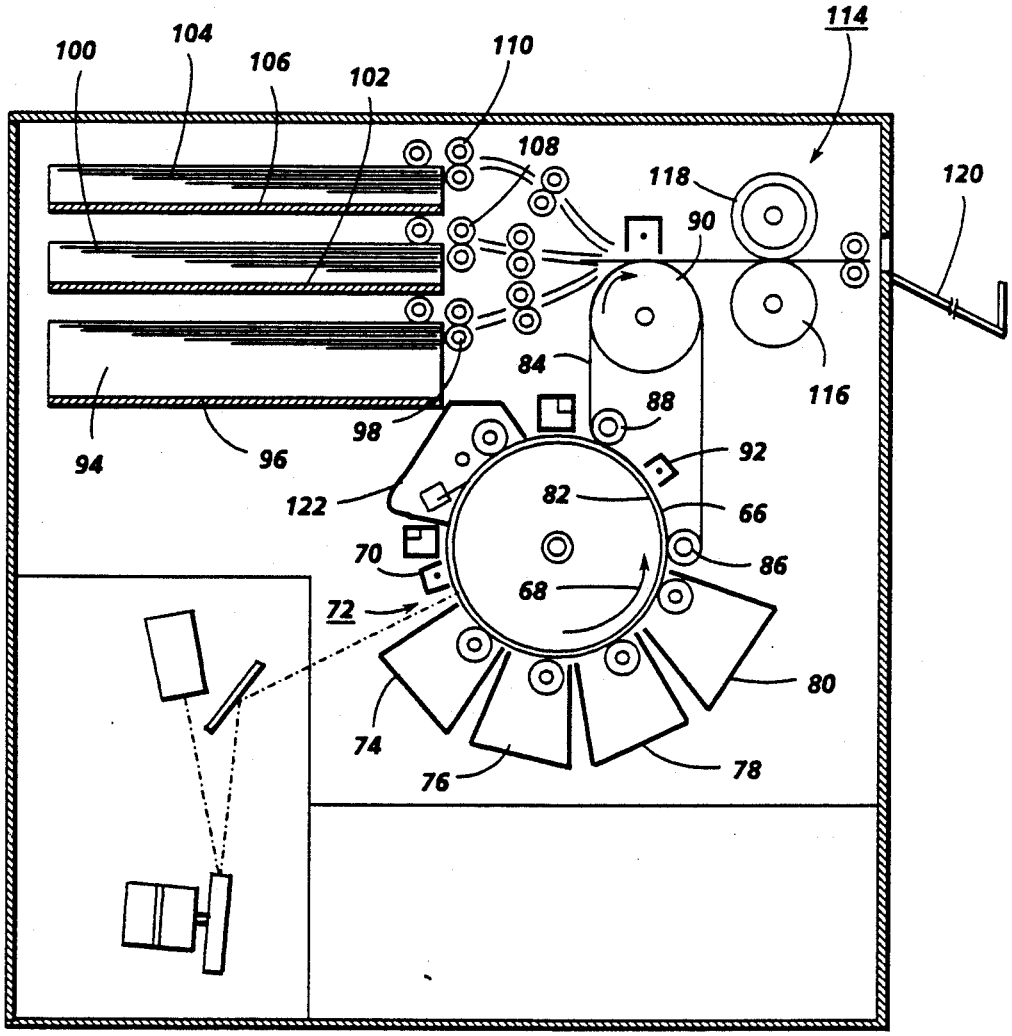

Other aspects of the present invention will become apparent as the following description proceeds and upon reference to the drawings, in which:

FIG. 1 is a schematic elevational view showing one embodiment of a multicolor printing system incorporating the features of the present invention therein; and FIG. 2 depict another embodiment of the FIG. 1 printing system.

While the present invention will hereinafter be described in conjunction with various embodiments thereof, it will be understood that it is not intended to limit the invention to these embodiments. On the contrary, it is intended to cover all alternatives, modifications, and equivalents as may be included in the spirit and scope of the invention as defined by the appended claims.

For a general understanding of the features of the present invention, reference is made to the drawings. In the drawings, like reference numerals have been used throughout to designate identical elements. Referring now to FIG. 1, a cylindrical metal drum, designated generally by reference numeral 10, is mounted rotatably on the machine frame. Drum 10 rotates in the direction of arrow 12. Four image reproducing stations, indicated generally by the reference numerals 14, 16, 18 and 20, are positioned about the periphery of drum 10. Each image reproducing station is substantially identical to one another. The only distinctions between the image reproducing stations is their geometric position and the color of the liquid developer material employed therein. For example, image reproducing station 14 uses a black colored liquid developer material while stations 16, 18, and 20 use yellow, magenta, and cyan colored liquid developer material. In as much as stations 14, 16, 18 and 20 are similar, only station 20 will be described in detail.

At station 20, a drum 22 having a photoconductive surface deposited on a conductive substrate rotates in the direction of arrow 24. Preferably, the photoconductive surface is made from a selenium alloy with the conductive substrate being made from an electrically grounded aluminum alloy. Other suitable photoconductive surfaces and conductive substrates may also be employed. Drum 22 rotates in the direction of arrow 24 to advance successive portions of the photoconductive surface through the various processing stations disposed about the path of movement thereof.

Initially, a portion of the photoconductive surface of drum 22 passes beneath a corona generating device, 26. Corona generating device 26 charges the photoconductive surface of drum 22 to a relatively high, substantially uniform potential.

Next, the charged portion of the photoconductive surface is advanced through imaging station. At the imaging station, an imaging unit, indicated generally by the reference numeral 28, records an electrostatic latent image on the photoconductive surface of drum 22. Imaging unit 22 includes a raster output scanner. The raster output scanner lays out the electrostatic latent image in a series of horizontal scan lines with each line having a specified number of pixels per inch. Preferably, the raster output scanner employs a laser which generates a beam of light rays that are modulated by rotating polygon mirror blocks or solid state image modulator bars. Alternatively, the raster output scanner may use light emitting diode array write bars. In this way, an electrostatic latent image is recorded on the photoconductive surface of drum 22.

Next, a developer unit, indicated generally by the reference numeral 30, develops the electrostatic latent image with a cyan colored liquid developer material. Image reproducing stations 14, 16, and 18 use black, yellow, and magenta colored liquid developer materials, respectively. The liquid developer material contacts the electrostatic latent image. Preferably, the developer material includes a clear liquid insulating carrier having pigmented particles, i.e. toner particles, dispersed therein A suitable clear insulating liquid carrier may be made from an aliphatic hydrocarbon, such as an Isopar, which is a trademark of the Exxon Corporation, having a low boiling point. The toner particles include a pigment associated with a polymer. A suitable liquid developer material is described in U.S. Pat. No. 4,582,774, issued to Landa in 1986, the relevant portions thereof being incorporated into the present application. Developer unit 30 has a developing liquid comprising a clear insulating carrier liquid and cyan toner particles. The developing liquid is circulated by a pump from a container through a pipe into a development tray mounted on the frame of the machine A development electrode, which may be appropriately electrically biased, assists in developing the electrostatic latent image with the black developing liquid. The charged toner particles, disseminated throughout the carrier liquid, pass by electrophoresis to the electrostatic latent image. The charge of the toner particles is opposite in polarity to the charge on the photoconductive surface. By way of example, if the photoconductive surface is made from a selenium alloy, the photoconductive surface will be positively charged and the toner particles will be negatively charged. Alternatively, if the photoconductive surface is made from a cadmium sulfide material, the photoconductive surface will be negatively charged and the toner particles will be positively charged. Generally, the amount of liquid carrier on the photoconductive surface is too great. A roller, whose surface moves in a direction opposite to the direction of movement of the photoconductive surface, is spaced from the photoconductive surface and adapted to shear excessive liquid from the developed image without disturbing the image. After development of the latent image adapted to be in black is completed, drum 22 continues to move in the direction of arrow 24 to advance the black liquid image a transfer zone 32 where the liquid developer material is transferred from drum 22 to intermediate drum 10.

At transfer zone 32, the developed liquid image is transferred from photoconductive drum 22 to intermediate drum 10. Drum 10 and drum 22 have substantially the same tangential velocity in transfer zone 32. Drum 10 is electrically biased to a potential of sufficient magnitude and polarity to attract the developed liquid image thereto from drum 22. Preferably, drum 10 is made from a conductive tube, such as aluminum, with an appropriate dielectric coating. A high voltage power supply applies a direct current bias voltage to drum 10 by suitable means such as a carbon brush and brass ring assembly. Preferably, drum 10 is electrically biased to about 3000 volts. However, this electrical bias may vary from about 1500 volts to about 4500 volts.

After the developed liquid image is transferred to drum 10 at reproducing station 20, drum 10 rotates the developed liquid image to the transfer zone of reproducing station 18 where the developed magenta liquid image is transferred to drum 10, in superimposed registration with the cyan liquid image previously transferred to drum 10. After the magenta liquid image is transferred to drum 10, drum 10 rotates the transferred liquid images to reproducing station 16 where the yellow liquid image is transferred to drum 10 in superimposed registration with the previously transferred liquid images. Finally, drum 10 rotates the transferred liquid images to reproducing station 14 where the black liquid image is transferred thereto in superimposed registration with the previously transferred liquid images. After all of the liquid images have been transferred to drum 10 in superimposed registration with one another to form a multicolor liquid image, the multicolor liquid image is transferred to a sheet of support material, e.g. a copy paper, at the transfer station.

At the transfer station, a copy sheet is moved into contact with the multicolor liquid image on drum 10. The copy sheet is advanced to transfer station from a stack of sheets 34 mounted on tray 36, by a sheet feeder 38, or from either a stack of sheets 40 on tray 42, or a stack of sheets 44 on tray 46 by either sheet feed 48 or sheet feeder 50. The copy sheet is advanced into contact with the multicolor liquid image on drum 10 beneath corona generating unit 52 at the transfer station. Corona generating unit 52 sprays ions onto the backside of the sheet to attract the multicolor liquid image to the front side thereof from drum 10. After transfer, the copy sheet continues to move in the direction of arrow 54 on a conveyor to a fusing station.

At the fusing station, a roll fusing system, indicated generally by the reference numeral 56, vaporizes the liquid carrier from the copy sheet and permanently fuses the multicolor toner, in image configuration, thereto. This forms a multicolor copy. The roll fusing system includes a heated fuser roller 58 and a back-up roller 60. The rollers are resiliently urged into engagement with one another to define a nip therebetween. The copy sheet passes through the nip with the liquid multicolor image contacting the fuser roller. After fusing, the copy sheet is advanced by a conveyor to catch tray 62 for subsequent removal from the printing machine by the operator.

Some residual liquid developer material remains adhering to the drum 10 after transfer. The residual developer material is removed from the drum surface at a cleaning station 64. Cleaning station 64 includes a cleaning roller, formed of any appropriate synthetic resin driven in a direction opposite to the direction of movement of drum 10 to scrub the surface thereof clean. To assist in this action, liquid carrier may be fed through pipe onto the surface of the cleaning roller. A wiper blade completes the cleaning of the surface.

Referring now to FIG. 2, there is shown another embodiment of the multicolor printing system. As shown thereat, the system includes a drum 66 having a photoconductive surface deposited on a conductive substrate. Preferably, the photoconductive surface is made from a selenium alloy with the conductive substrate being made from an electrically grounded aluminum alloy. Other suitable photoconductive surfaces and conductive substrates may also be employed. Drum 66 moves in the direction of arrow 68 to advance successive portions of the photoconductive surface through the various processing stations disposed about the path of movement thereof Initially, a portion of drum 66 passes beneath a corona generating device, indicated generally by the reference numeral 70. The corona generating device charges the photoconductive surface of drum 66 to a relatively high, substantially uniform potential.

Next, the charged portion of the photoconductive surface of drum 66 is advanced through imaging station. At the imaging station, an imaging unit, indicated generally by the reference numeral 72, records an electrostatic latent image on the photoconductive surface of drum 66. Imaging unit 72 includes a raster output scanner. The raster output scanner lays out the electrostatic latent image in a series of horizontal scan lines with each line having a specified number of pixels per inch. Preferably, the raster output scanner employs a laser which generates a beam of light rays that are modulated by rotating polygon mirror blocks or solid state image modulator bars. Alternatively, the raster output scanner may use light emitting diode array write bars. In this way, an electrostatic latent image is recorded on the photoconductive surface of drum 66.

After the latent image is recorded on the surface of drum 66, drum 66 rotates the latent image to the development station. The development station includes four developer units, indicated generally by the reference numerals 74, 76, 78, and 80. Each of the developer units is substantially identical to one another with the only distinction being the geometric position of the respective developer unit and the color of the liquid developer material used therein. Developer unit 66 employs a cyan liquid developer material while developer units 76, 78 and 80 use magenta, yellow and black colored liquid developer materials, respectively. Inasmuch as all of the developer units are similar, only developer unit 74 will be described in detail. The liquid developer material contacts the electrostatic latent image. Preferably, the developer material includes a clear liquid insulating carrier having pigmented particles, i.e. toner particles, dispersed therein A suitable clear insulating liquid carrier may be made from an aliphatic hydrocarbon, such as an Isopar, which is a trademark of the Exxon Corporation, having a low boiling point. The toner particles include a pigment associated with a polymer. A suitable liquid developer material is described in U.S. Pat. No. 4,582,774, issued to Landa in 1986, the relevant portions thereof being incorporated into the present application. Developer unit 74 has a developing liquid comprising a clear insulating carrier liquid and cyan toner particles. The developing liquid is circulated by a pump from a container through a pipe into a development tray mounted on the frame of the machine A development electrode, which may be appropriately electrically biased, assists in developing the electrostatic latent image with the cyan developing liquid. The charged toner particles, disseminated throughout the carrier liquid, pass by electrophoresis to the electrostatic latent image. The charge of the toner particles is opposite in polarity to the charge on the photoconductive surface. By way of example, if the photoconductive surface is made from a selenium alloy, the photoconductive surface will be positively charged and the toner particles will be negatively charged. Alternatively, if the photoconductive surface is made from a cadmium sulfide material, the photoconductive surface will be negatively charged and the toner particles will be positively charged. Generally, the amount of liquid carrier on the photoconductive surface is too great. A roller, whose surface moves in a direction opposite to the direction of movement of the photoconductive surface, is spaced from the photoconductive surface and adapted to shear excessive liquid from the developed image without disturbing the image. After development of the latent image adapted to be in cyan is completed, drum 66 continues to move in the direction of arrow 68 to advance the cyan liquid image a transfer zone 82 where the cyan liquid image is transferred from drum 66 to intermediate belt. 84.

At transfer zone 82, the developed liquid image is transferred from photoconductive drum 66 to intermediate belt 84. Belt 84 and drum 66 have substantially the same tangential velocity in transfer zone 82. Belt 84 is an endless belt entrained about a plurality of spaced rollers 86, 88, and 90. Belt 84 is made from an elastomeric material. However, any material having the desired characteristics is suitable. A corona generator 92 is positioned on the side of belt 84 opposed from drum 66 in transfer zone 82. Corona generator 92 sprays ions onto the backside of belt 84 to attract the cyan liquid image from drum 66 to belt 84.

In a similar manner, electrostatic latent images recorded on drum 66 for the next cycles are developed with magenta, yellow and black liquid developer materials. These liquid images are transferred to belt 84 in superimposed registration with one another and with the cyan liquid image previously transferred thereto to form a multicolor liquid image on belt 84. Belt 84 advances the multicolor liquid image to a transfer station.

At the transfer station, a copy sheet is moved into contact with the multicolor liquid image on belt 84. The copy sheet is advanced to a transfer station from a stack of sheets 94 mounted on tray 96, by a sheet feeder 98, or from either a stack of sheets 100 on tray 102 or a stack of sheets 104 on tray 106 by either sheet feeder 108 or sheet feeder 110. The copy sheet is advanced into contact with the multicolor liquid image on belt 84 beneath corona generating unit 112 at the transfer station. Corona generating unit 112 sprays ions onto the backside of the sheet to attract the multicolor liquid image to the front side thereof from belt 84. After transfer, the copy sheet continues to move on a conveyor to a fusing station.

At the fusing station, a roll fusing system, indicated generally by the reference numeral 144, vaporizes the liquid carrier from the copy sheet and permanently fuses the multicolor toner, in image configuration, thereto. This forms a multicolor copy. The roll fusing system includes a heated fuser roller 116 and a back-up roller 118. The rollers are resiliently urged into engagement with one another to define a nip therebetween. The copy sheet passes through the nip with the liquid multicolor image contacting the fuser roller. After fusing, the copy sheet is advanced by a conveyor to catch tray 120 for subsequent removal from the printing machine by the operator.

Some residual liquid developer material remains adhering to the 66 after transfer. This residual developer material is removed from the drum surface at a cleaning station 122. Cleaning station 122 includes a cleaning roller, formed of any appropriate synthetic resin driven in a direction opposite to the direction of movement of 66 to scrub the surface thereof clean. To assist in this action, liquid carrier may be fed through pipe onto the surface of the cleaning roller. A wiper blade completes the cleaning of the surface.

In recapitulation, it is evident that the muticolor printing system of the present invention transfers successive differently colored liquid images to an intermediate member in superimposed registration with one another to form a multicolor liquid image thereon. The multicolor liquid image is then transferred to a sheet of support material and permanently fused thereto.

It is, therefore, apparent that there has been provided in accordance with the present invention, a multicolor printing system that fully satisfies the aims and advantages hereinbefore set forth. While this invention has been described in conjunction with various embodiments thereof, it is evident that many alternatives, modifications and variations will be apparent to those skilled in the art. Accordingly, it is intended to cover all such alternatives, modifications and variations that fall within the spirit and broad scope of the appended claims.

We claim:

1. A multicolor printing system of the type having a plurality of latent images recorded therein, including:

a plurality of photoconductive members;

means for recording one of said plurality of latent images on one of said plurality of photoconductive members means for developing each of the plurality of latent images with a different color liquid developer material to form a plurality of different color liquid images;

an intermediate member, positioned closely adjacent to each one of said plurality of photoconductive members;

first means for transferring each one of the plurality of different color liquid images to said intermediate member in superimposed registration with one another to form a multicolor liquid image thereon second means for transferring the multicolor liquid image from said intermediate member to a sheet of support material; and means for fusing the multicolor liquid image to the sheet of support material.

2. A printing system according to claim 1, wherein said intermediate member includes a cylindrical member.

* * * * *